US006378945B1

(12) United States Patent
Krueger

(10) Patent No.: US 6,378,945 B1
(45) Date of Patent: Apr. 30, 2002

(54) STOOL WITH DETACHABLE SEAT

(75) Inventor: Todd D. Krueger, Lillington, NC (US)

(73) Assignee: Bob Barker Company, Inc., Fuquay-Varina, NC (US)

( * ) Notice: Subject to any disclaimer, the term of this patent is extended or adjusted under 35 U.S.C. 154(b) by 0 days.

(21) Appl. No.: 09/753,155

(22) Filed: Jan. 2, 2001

(51) Int. Cl.[7] ..... A47C 7/00
(52) U.S. Cl. ..... 297/440.22; 297/451.4; 108/158
(58) Field of Search ..... 297/440.22, 445.1, 297/451.4, 451.5, 451.6, 440.2; 411/399, 910, 180; 108/150, 158, 157.13

(56) References Cited

U.S. PATENT DOCUMENTS 1,558,612 A * 10/1925 Hohorst ..... 108/158
3,742,870 A * 7/1973 Gusdorf et al. ..... 108/150
4,676,551 A * 6/1987 McDowell ..... 297/439
5,603,472 A * 2/1997 Hutter, III ..... 244/132
5,697,305 A * 12/1997 Chassan et al. ..... 108/153
5,720,524 A * 2/1998 Hall ..... 297/338
6,176,545 B1 * 1/2001 Hambleton ..... 297/4

OTHER PUBLICATIONS

Norix Max–Master Tables brochure, date unknown.

* cited by examiner

*Primary Examiner*—Peter M. Cuomo
*Assistant Examiner*—Stephanie Harris
(74) *Attorney, Agent, or Firm*—Coats & Bennett, PLLC

(57) ABSTRACT

A stool comprising a seat mounted to a leg assembly. Apertures within the seat are sized to contain fasteners that mount the seat to the leg assembly. Nuts are positioned on a bottom edge of the seat to receive the fasteners. In one embodiment, the present invention is used within institutional facilities because the stool is difficult to disassemble without tools or excessive amounts of force.

16 Claims, 7 Drawing Sheets

STOOL WITH DETACHABLE SEAT

BACKGROUND OF THE INVENTION

The present invention is directed to a stool comprising a detachable seat and a leg assembly. The seat is attached to the leg assembly via a plurality of fasteners and nuts which are difficult to remove making the stool ideal for institutional use.

Stools for use in an institutional setting such as a prison or correctional facility have different requirements than those encountered in non-institutional settings. One important aspect is that the seat not be easily disassembled using only one's hands. When an inmate is sitting on the seat, they may attempt to disassemble the pieces without drawing the attention of any guards watching over them. If successful, they may take the seat pieces and make a weapon to injure the guards or other inmates, or somehow facilitate their escape.

It is also important that none of the seat pieces have sharp edges. Inmates have copious amounts of time to conjure up methods of escape and/or injuring others. Although it seems unlikely, an inmate may be able to conjure a manner to injure and/or escape using a sharp edge or piece of the seat. If their resourcefulness was channeled to more positive endeavors, the world would probably be a better place and the inmate probably would not be in their predicament in the first place.

The stool should also be as comfortable as possible for the user. It should provide a secure support that doesn't wobble or otherwise make the user feel that they may fall. Preferably, the top surface of the seat is substantially flat with no protruding edges or fasteners that would dig into the user making it uncomfortable.

The stool should also be inexpensive for the correctional facility to purchase. Budgets are constantly being cut for these institutions, leaving less and less funding for purchasing the necessary supplies. Therefore, the stool should solve the above-addressed needs without costing an amount that is in excessive of the facility's budget.

SUMMARY OF THE INVENTION

The present invention is directed to a stool that is difficult to disassemble without proper tools. The stool has a variety of uses, and is especially applicable for use in a correctional facility. The stool provides a stable support for the user, and is constructed to have a substantially flat surface on which the user sits.

In one embodiment, the stool comprises a seat having at least three apertures spaced equally about a center point. Each of the apertures is angled outward to have a larger diameter at a top surface and a smaller diameter at a bottom surface. A fastener is positioned within each of the apertures. Each fastener includes a head and a shaft. The head is tapered to conform to the apertures such that the head is substantially flush with the top surface of the seat. The shaft is threaded and sized to extend through the seat bottom surface. A nut abuts against the surface of the seat bottom adjacent to each of the apertures and includes a threaded cavity and a neck. A leg assembly is mounted to the bottom of the seat for support it above the ground.

The apertures may be positioned on a top platform of the seat, or they may be positioned on a side edge that extends around the top platform. The apertures may further be countersunk apertures or indents.

DETAILED DESCRIPTION OF THE INVENTION

Figure 1:
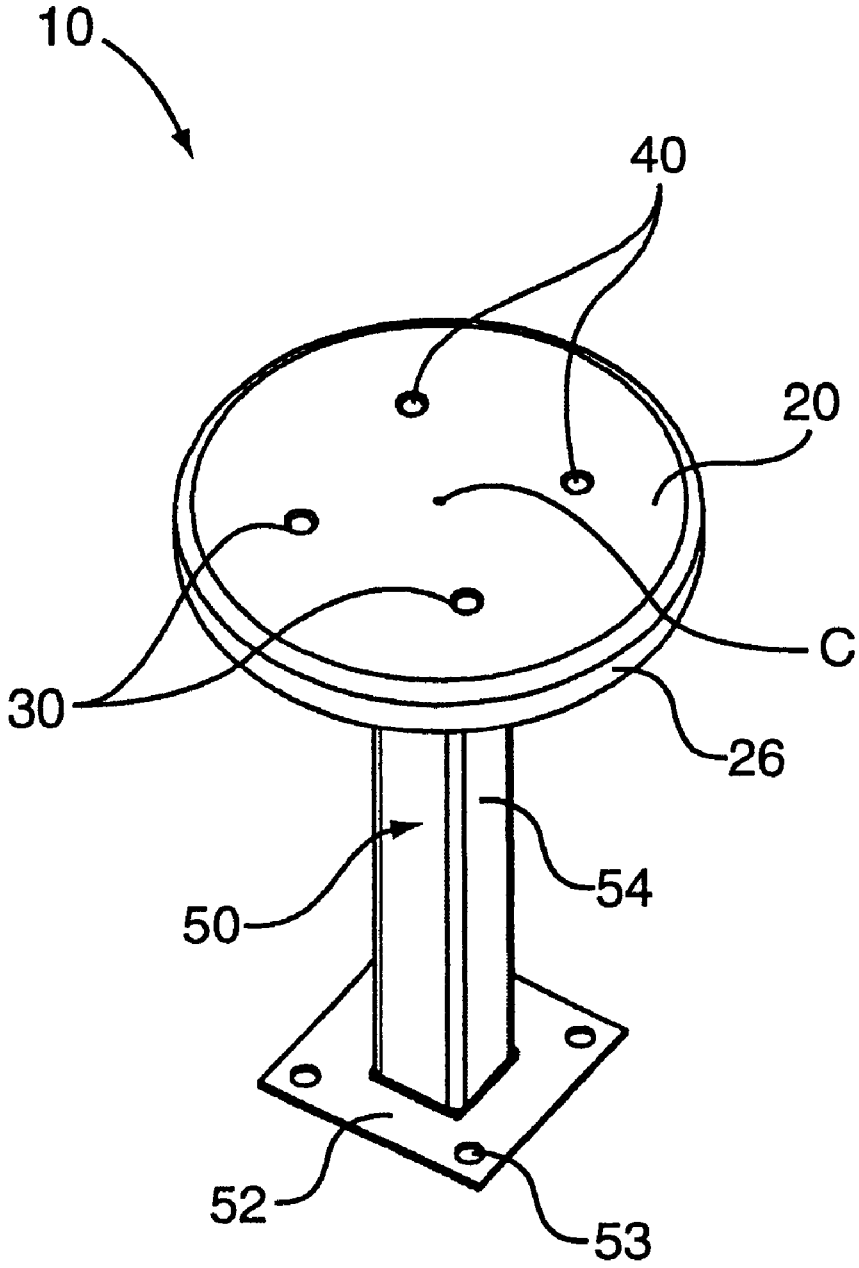
FIG. 1 is a perspective view of a stool constructed according to one embodiment of the present invention.

FIG. 1 illustrates a stool 10 constructed according to one embodiment of the present invention. Stool 10 comprises a seat 20 mounted to a leg assembly 50. Apertures 30 within the seat 20 are sized to contain fasteners 40 that mount the seat 20 to the leg assembly 50. Nuts 60 (FIG. 2) are positioned on a bottom side of the seat 20 to receive the fasteners 40. In one embodiment, the present invention is used within institutional facilities because the stool 10 is difficult to disassemble without tools or excessive amounts of force. However, the stool 10 may also be used in various other contexts as is understood by one skilled in the art.

Seat 20 comprises a top platform 24, on which the user sits. Top platform 24 includes a plurality of apertures 30 to receive the fasteners 40 used to secure the seat 20 to the leg assembly 50. Apertures 30 are positioned about the top platform 24 and may have a variety of dimensions and sizes. In one embodiment, each aperture 30 is positioned an equal distance from a center point C and spaced apart equally from the other apertures 30. Seat 20 may further comprise a lip 26 extending around the outer edge of the top platform 24. Lip 26 provides for a more comfortable feel for the user and prevents the edge of the top platform 24 from rubbing against the user's legs. In one embodiment, seat 20 has a thickness in the range of between about $^{72}/_{1000}$ to $^{77}/_{1000}$ inches.

Figure 4:
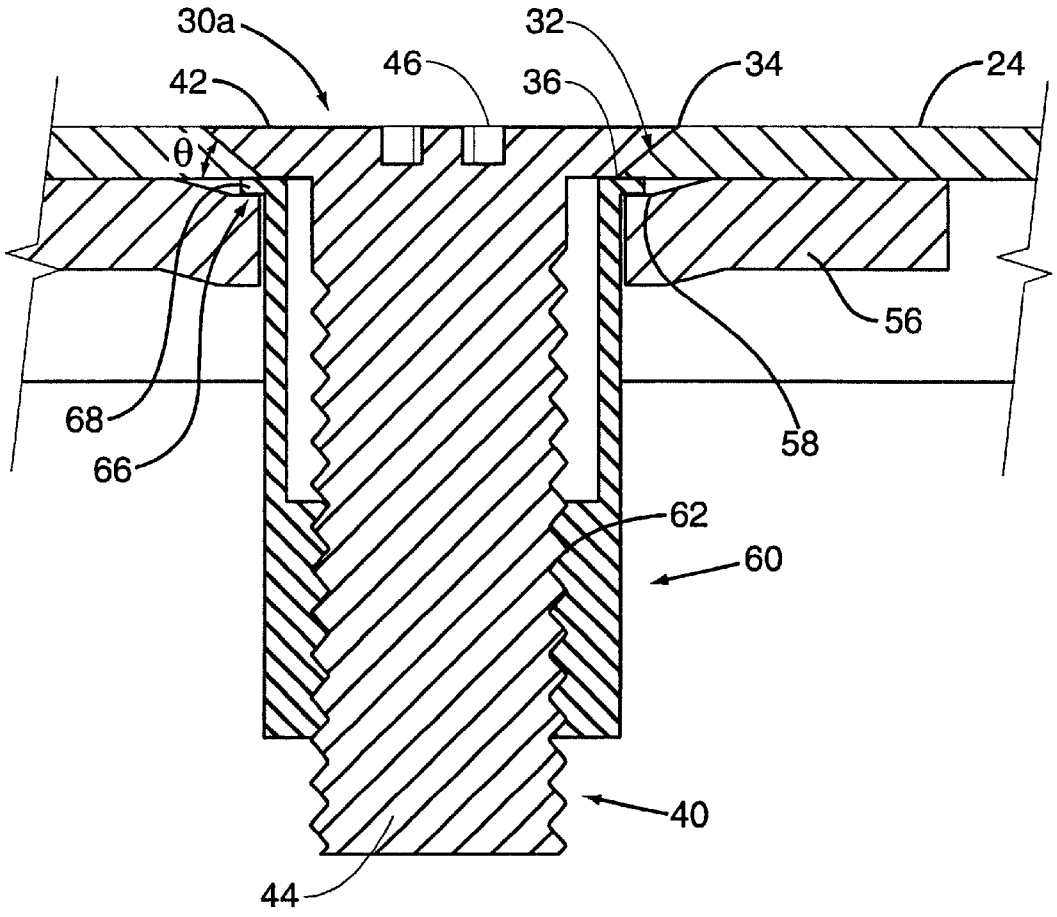
FIG. 4 is a cross-sectional view of one embodiment of a fastener mounted within the seat and nut.
Figure 5:
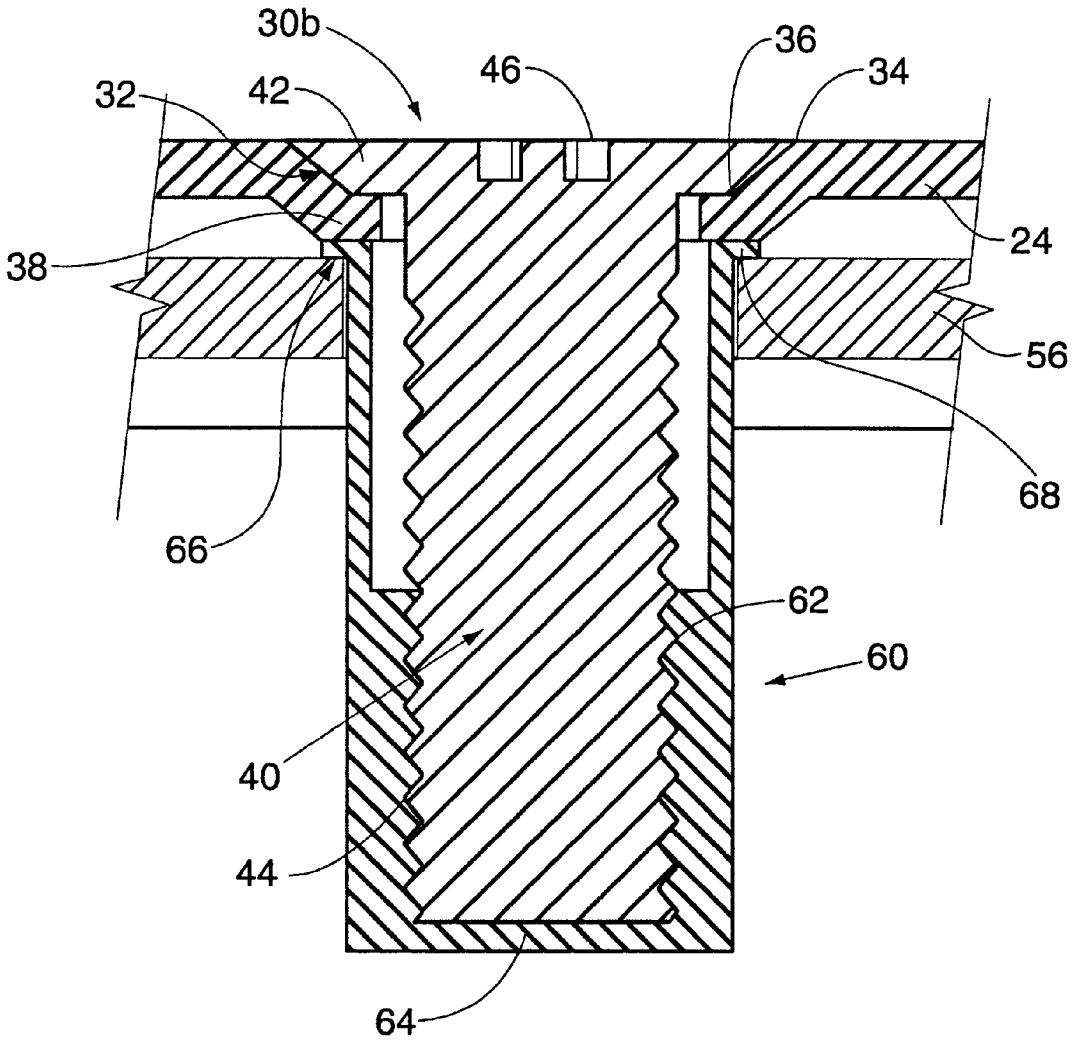
FIG. 5 is a cross-sectional view illustrating a second embodiment of a fasteners mounted within a seat and nut.

Apertures 30 may have a variety of dimensions and orientations including a countersunk aperture 30*a* illustrated in FIG. 4 and an indented aperture 30*b* illustrated in FIG. 5. Apertures 30 include angled edges 32 that have a larger outer diameter 34 and a smaller inner diameter 36. Edges 32 may also have a variety of orientations such that the angle $\theta$ is substantially perpendicular to the top platform 24, to angle $\theta$ being less than about ten degrees. In one embodiment, angle $\theta$ is about thirty-five degrees. The angle $\theta$ is necessary to provide a surface for the fastener head 42 to push against. FIG. 5 illustrates the indented aperture 30*b* in which the top platform 24 is indented inward forming a lower surface 38 positioned below and substantially parallel with the top platform 24.

Fasteners 40 extend between the seat 20, leg assembly 50 and nut 60 to hold the stool 10 together. Fasteners 40 include a head 42 and an integral threaded shaft 44. The head 42 is dimensioned to conform to the shape and size of the aperture 30 such that there is little to no space between the angled edge 32 and the fastener head 42. These close tolerances prevent a user from grasping the head 42 and removing the fastener 40. When the fastener 40 is seated within the aperture 30, the top surface of the head 42 is substantially flush with the top surface of the seat 20. This provides for a more comfortable feel for the user. A tool receiver 46 is positioned on the top surface of the head 42 for insertion and removal.

Leg assembly 50 supports the seat 20. In the embodiment illustrated in FIGS. 1 and 2, leg assembly 50 comprises at least one leg 54 and a top mounting plate 56. Top mounting plate 56 is substantially flat to mate against the bottom surface of the seat 20. Plate 56 includes a plurality of holes that align with apertures 30 in the seat 20 such that the fasteners 40 can extend therethrough. In the embodiments illustrated, a single leg 54 extends outward from the top mounting plate 56 to support the seat 20, although more than one leg 54 may be used and is contemplated by the present invention.

Figure 3:
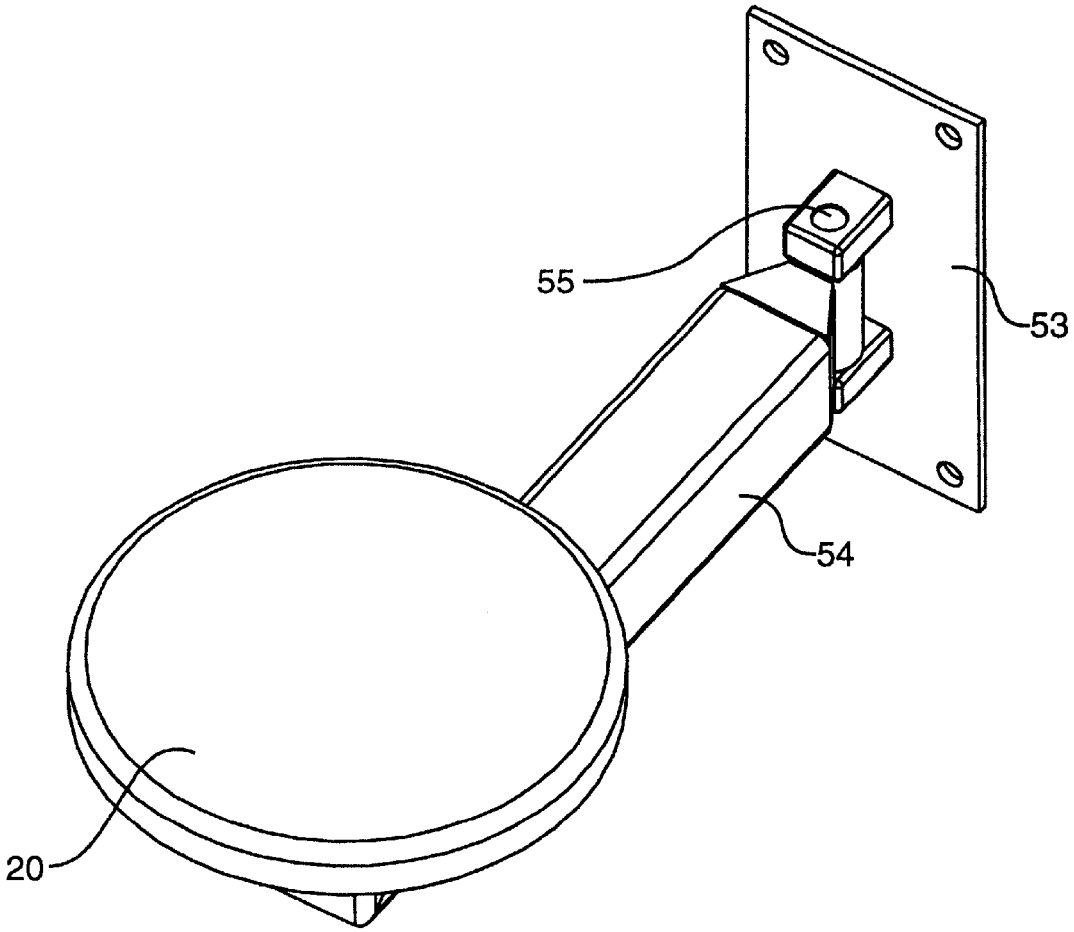
FIG. 3 is a partial perspective view of a leg assembly constructed according to one embodiment of the present invention.
Figure 7:
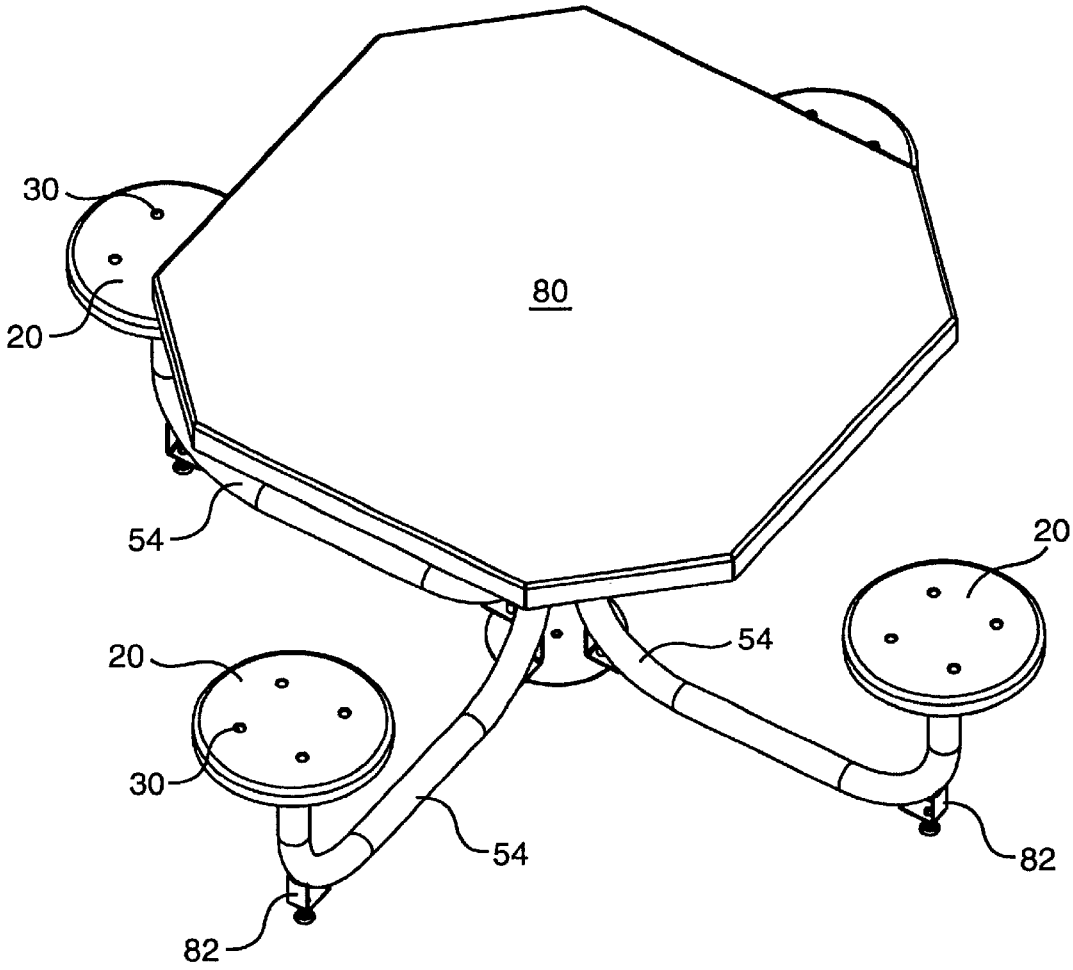
FIG. 7 is a perspective view of a table using a plurality of seats constructed in accordance with the present invention.

The leg 54 of the leg assembly 50 may have a variety of orientations. As illustrated in FIG. 1, leg 54 may be substantially straight and attach to the floor via a plate 52 mounted opposite the top mounting plate 56. Apertures 53 may be positioned about the base plate 52 to mate with mounting brackets (not illustrated) mounted within the floor to secure the stool 10. FIG. 3 illustrates another embodiment in which the leg assembly 54 includes a pivot 55 for the seat 20 to be positioned at a variety of orientations as the base plate 52 attaches to a wall. Another embodiment is illustrated in FIG. 7 in which a plurality of seats 20 are positioned around a table 80. Leg assemblies 54 are angled to extend outward from an underside of the table 80. Supports 82 may further extend from each leg assembly 82.

Figure 2:
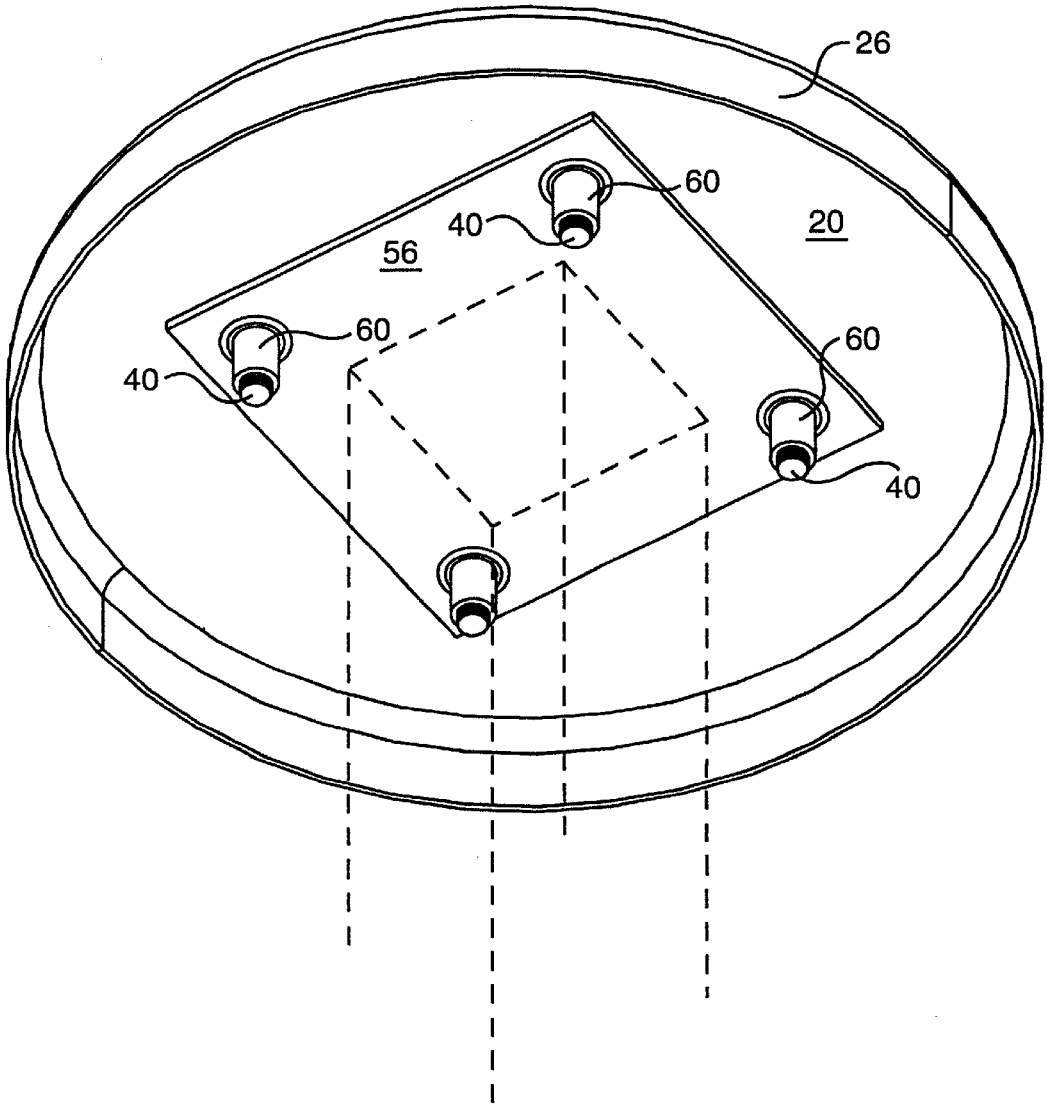
FIG. 2 is a perspective view of the bottom of the seat with the leg assembly mounted via fasteners and nuts and the leg illustrated in hidden lines.
Figure 6:
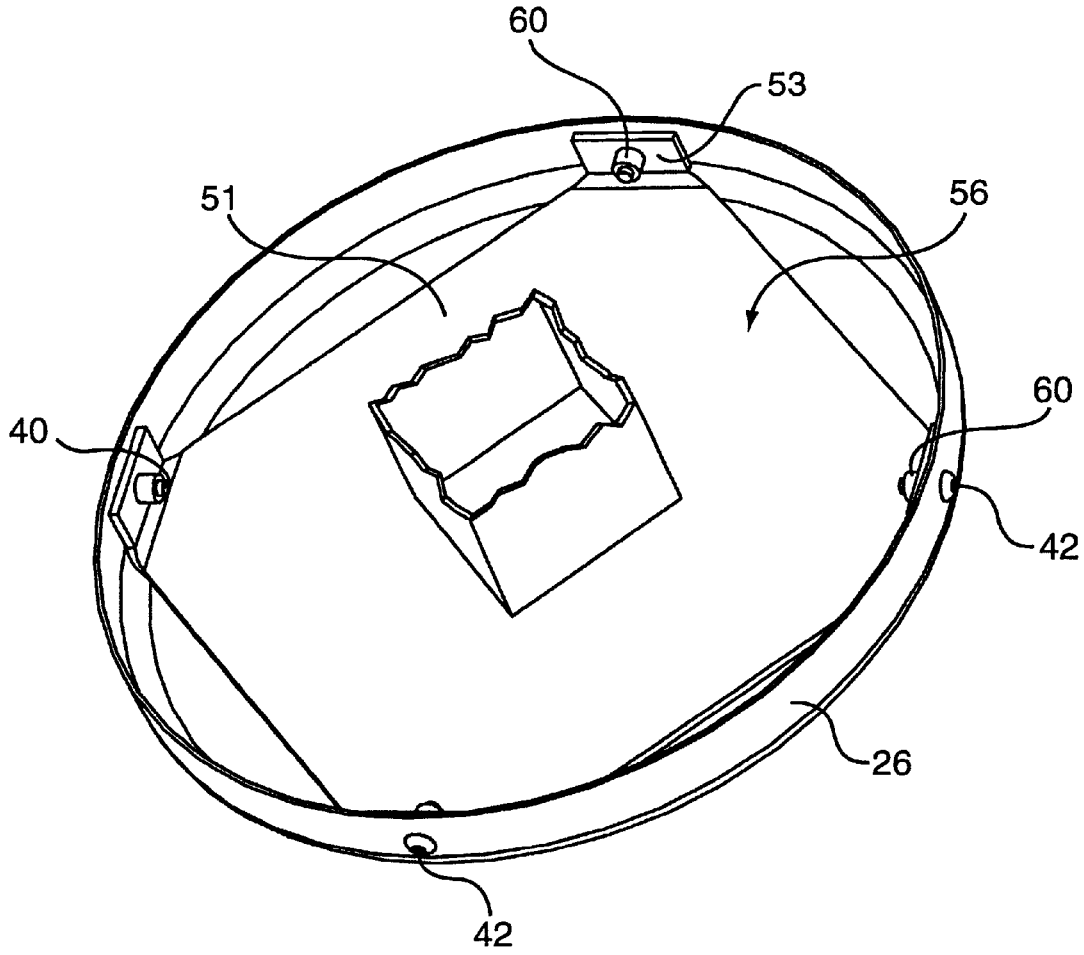
FIG. 6 is a partial perspective view illustrating an alternative embodiment of the fasteners extending through the seat edge.

Nuts 60 are aligned with the apertures 30 to receive the fasteners 40. Nuts 60 have an inner threaded surface 62. Interior cavity may extend through the entire length of the nut 60 as illustrated in FIGS. 2, 4, and 6, or may include an end section 64 to fully surround the fastener 40 as illustrated in FIG. 5. In one embodiment illustrated in FIGS. 4 and 5, an upper edge 66 abuts the bottom edge of the seat. Upper edge 66 may further include a flange 68 such that more surface area touches the seat 20. In one embodiment, nut 60 is a Blind Threaded Captive Fastener constructed by AVK Industrial Products. Once the fastener 40 is inserted and tightened into the nut 60, the nut 60 crimps around the mounting plate 56 making it difficult to extract without the proper tools.

In the embodiment illustrated in FIG. 4, the thickness of the fastener head 42 is about equal to the thickness of the seat 20. Additionally, the angled edges 32 correspond to the fastener head edges that center the fastener 40 within the aperture 30*a*. The upper edge 66 of the nut 60 abuts against both the bottom surface of the seat 20 and the bottom surface of the fastener head 42. When the fastener 40 is tightened within the nut 60, these three surfaces are pressed together. Leg assembly top mounting plate 56 may further include indent 58 to ensure contact between the nut upper edge and the seat 20 and fastener head 42 as a large surface area of the top mounting plate 56 further abuts against the underside of the seat platform 24 to stabilize the seat 20.

Another embodiment is illustrated in FIG. 5 in which the seat 20 is indented inward. A bottom edge of fastener head 42 contacts a lower shelf 38 as again the fastener head 42 conforms to the dimensions of the indent 30*b*. The nut upper edge 66 mates against the bottom edge of the indent 30*b* and does not directly contact the fastener head 42. Again, as the fastener 40 is tightened into the nut 60, the three separate elements are pulled together.

In both embodiments, the edges of the fastener head 42, aperture 30 and nut end contact each other such that there is no space formed between them. This orientation provides for a secure attachment that is difficult to be taken apart by hand.

FIG. 6 illustrates an alternative embodiment of the present invention in which the leg assembly top mounting plate 52 is attached to the seat lip 26. Top mounting plate 52 comprises a substantially flat inner section 51 which abuts substantially against the bottom surface of the seat 20. Sections 53 are angled relative to the inner section 51 to mount against lip 26. Apertures 30, either holes 30*a* or indents 30*b* are positioned within the lip 26 and align with apertures in the sections 53 to receive fastener 40. Nuts 60 attach to the fastener shaft 44 as with the other embodiments for securely attaching the seat 20 to the leg assembly 50.

In one embodiment, there are four apertures 30 positioned about the face of the seat 20. Each of the apertures 30 are evenly spaced from a center point C. In the event that a person attempts to forcibly remove the seat 20 from the leg assembly 50, the user must overcome the combination of each of the fasteners 40 and is not able to isolate a single fastener 40 which would individually require less force to remove. The stool 10 must include at least three fasteners 40 for mounting the seat 20 to the leg assembly 50. Additional fasteners 40 may be provided and distributed about the seat 20 in a variety of orientations and are considered to be included within the scope of the present invention.

The present invention may be carried out in other specific ways than those herein set forth without departing from the scope and essential characteristics of the invention. In one embodiment, a lock washer (not illustrated) may also be positioned around the fastener 40 to prevent removal. Stool 10 may be used in a variety of embodiments, including a stand-alone stool as illustrated in FIG. 1, or as part of a table 80. The present embodiments are, therefore, to be considered in all respects as illustrative and not restrictive, and all changes coming within the meaning and equivalency range of the appended claims are intended to be embraced therein.

What is claimed is:

1. A stool comprising:

a seat having at least three apertures spaced equally about a center point, each of said apertures being angled outward to have a larger diameter at a top surface and a smaller diameter at a bottom surface;

a fastener positioned within each of said apertures, each fastener comprising a head and a shaft, said head being tapered to conform to said apertures such that said head is substantially flush with said seat top surface, said shaft being threaded and sized to extend through said seat bottom surface;

a nut abutting against said seat bottom surface adjacent to each of said apertures, each of said nuts having a threaded cavity and a neck, said threaded cavity being sized to receive said fastener shaft and said neck to abut against said seat bottom surface and a bottom edge of said fastener head; and a leg assembly mounted to said seat.

2. The stool of claim 1, wherein said apertures are positioned about a top platform of said seat.

3. The stool of claim 1, wherein said seat has a top platform and a side edge extending around said top platform, said apertures being positioned on said side edge.

4. The stool of claim 1, wherein said seat top platform has thickness about equal to a thickness of said fastener head.

5. The stool of claim 4, wherein said fastener thickness is within about five percent of said top platform thickness.

6. The stool of claim 1, wherein said apertures are indents having an angled edge and a lower shelf.

7. The stool of claim 1, wherein said apertures are holes having an angled edge.

8. The stool of claim 1, wherein said seat comprises four apertures.

9. The stool of claim 1, wherein said leg assembly further comprises a mounting plate having apertures that align with said seat apertures.

10. A stool for use in an institutional facility comprising:

a seat having a top surface and a bottom surface;

at least three apertures positioned about said seat, said apertures comprising angled edges and a lower shelf;

a fastener positioned within each of said apertures, each of said fasteners having a head sized to mate with said angled edges such that a fastener top surface is substantially flush with said seat top surface and a fastener bottom surface positioned against said lower shelf, said fastener further comprising a shaft extending outward from said head, said shaft having a smaller diameter than said head;

a nut having a cavity for receiving said fastener shaft, said nut having an upper end that abuts against said seat lower shelf; and a leg assembly detachably mounted to said seat.

11. The stool of claim 10, wherein said fastener head comprises an edge that mates with said aperture angled edge.

12. The stool of claim 10, wherein said aperture angled edge is substantially vertical and said fastener head comprises an edge that mates with said hole.

13. The stool of claim 10, wherein a thickness of said seat is about equal to a thickness of said fastener head.

14. The stool of claim 10, wherein said fastener shaft extends through the entire length of said nut cavity.

15. The stool of claim 10, wherein said nut upper end includes a flange that is positioned between said leg assembly and said fastener head.

16. A stool for use in a correctional institution comprising:

a seat having a top platform and an edge extending around said top platform;

a plurality of apertures extending through said edge, each of said apertures having an angled edge;

a fastener positioned within each of said apertures, each fastener comprising a head and a shaft, said head being tapered to conform to said aperture angled edge such that said head is substantially flush with a surface of said edge, said shaft being threaded and sized to extend through said edge;

a nut positioned adjacent to each aperture to receive said fastener; and a leg assembly having: (i) a mounting plate having a substantially flat section positioned adjacent to a bottom surface of said seat, and connecting sections angled from said substantially flat section and having holes that align with said apertures, and (ii) at least one leg extending from a mounting plate.

* * * * *